United States Patent [19]

Graybill

[11] 3,970,730

[45] July 20, 1976

[54] VARIABLE VENTURI CARBURETOR

[76] Inventor: Clinton L. Graybill, P.O. Box 396, Superior, Mont. 59872

[22] Filed: Feb. 7, 1975

[21] Appl. No.: 548,166

[52] U.S. Cl. ..... 261/41 D; 261/121 A; 261/62; 261/121 B; 261/DIG. 63

[51] Int. Cl.[2] ..... F02M 7/24

[58] Field of Search ..... 261/DIG. 63, DIG. 61, 261/DIG. 62, DIG. 64, 41 D, 62, 121 A, 121 B

[56] References Cited

UNITED STATES PATENTS

| | | | |
|---|---|---|---|
| 1,184,873 | 5/1916 | Raymond | 261/DIG. 64 |
| 1,394,452 | 10/1921 | Taft | 261/62 |
| 1,441,992 | 1/1923 | Meden | 261/62 |
| 1,467,333 | 9/1923 | Riege | 261/DIG. 64 |
| 1,623,347 | 4/1927 | Kelley et al. | 261/62 |
| 1,733,668 | 10/1929 | Leibing | 261/DIG. 63 |
| 1,803,150 | 4/1931 | Stokes | 261/121 A |
| 1,944,547 | 1/1934 | Dansreau | 261/DIG. 63 |
| 2,887,309 | 5/1959 | Raynor | 261/50 A |

FOREIGN PATENTS OR APPLICATIONS

| | | | |
|---|---|---|---|
| 270,012 | 12/1929 | Italy | 261/62 |
| 136,280 | 12/1919 | United Kingdom | 261/62 |

*Primary Examiner*—Tim R. Miles
*Attorney, Agent, or Firm*—Wells, St. John & Roberts

[57] ABSTRACT

A variable venturi carburetor comprised of an open induction duct enclosing coaxial inside first and outside second venturi members. The second venturi member is axially movable relative to the first venturi member in response to operation of a throttle linkage to vary the volume and velocity of air passing through a restricted cross section between the two venturi members and into a downstream mixing chamber. Fuel, supplied from a float chamber within the induction duct, is released into the inwardly moving air through a fuel supply orifice and an idle fuel supply orifice. An idle air supply is provided to bypass the restricted cross section under idling conditions. Also, an intermediate phase bypass duct is provided to release air into the mixing chamber, in addition to air entering through the restricted cross section, during intermediate R. P. M. conditions. The caburetor is also designed to bleed air into the fuel being delivered to the mixing chamber in order to supply a pre-mixed charge to the mixing chamber that may then be thoroughly mixed with the air in the chamber.

17 Claims, 6 Drawing Figures

VARIABLE VENTURI CARBURETOR

BACKGROUND OF THE INVENTION

The present invention relates basically to the field of carburetion for internal combustion engines and more particularly to carburetors utilizing a variable venturi.

Most present automobile carburetors are designed with a fixed venturi to create a vacuum pressure in the induction duct in order to pull fuel from a fuel reservoir. The venturi, by its fixed nature, operates at a maximum efficiency over a small range of engine R.P.M. Furthermore, a different size venturi is generally required for different size engines in performance requirements. Seldom is an automobile operated in only the small range of speeds required for the maximum operational efficiency of the fixed venturi. Consequently, various complicated venturi arrangements including multiple venturi tubes have been included in carburetors in an attempt to make the carburetor more efficient over a wide range of operating conditions. A venturi is generally most ineffective at slow speeds in which the velocity of air through the induction duct is minimal. Special idle jets have been incorporated in curburetors in order to overcome this problem by passing additional fuel to the engine at low R.P.M. At higher R.P.M., the fuel from the special idle jet is not required and therefore provides a richer mixture than is needed for that particular R.P.M. range. This results in loss of fuel in an over rich mixture of fuel to air. This loss is particularly notable at high speeds and during deceleration.

Other features have been added to carburetors to overcome the limitations noted with the fixed venturi type carburetor. One limitation is recognized when the carburetor is operating at low engine R.P.M. When the operator desires to quickly accelerate the automobile, quick depression of the throttle pedal causes the throttle valve to rapidly open. This allows for additional amounts of air to flow through the venturi before the vacuum pressure is increased to a higher R.P.M. in order to draw additional fuel. Consequently, it is not infrequent that the engine will stall on the initial lean mixture. To overcome this limitation, accelerator fuel pumps have been incorporated in carburetors to operate in response to depression of the throttle pedal to pump additional fuel into the mixing chamber when the throttle is depressed rapidly. However, such a compromise results in a loss of fuel when the vehicle is traveling at high speeds and the accelerator pump is temporarily released and then depressed again. The pump adds the additional fuel to the engine which is wasted since the high air velocity through the venturi is sufficient to pull enough fuel into the cylinders to accomplish the objective without the necessity of the fuel pump.

It may be seen then that additional features added to existing fixed venturi carburetors frequently cause additional inefficiencies that balance with the limitations that they themselves introduce. All the above mentioned and further features attempt to compensate for the inefficiencies of the venturi over the full range of operating conditions and R.P.M. Ideally, the carburetor for an automobile should operate at high efficiency over the full range of engine operating R.P.M. and load conditions.

Conventional air valve type carburetors have been utilized in an attempt to maintain a constant air velocity across a fuel jet orifice independent of the throttle valve position and engine speed. Such carburetors generally attempt to vary the size of the fuel jet in accordance with the amount of air entering the carburetor to therefore provide a correct "airfuel ratio". Engines having such air valve carburetors are generally difficult to start and operate at idling R.P.M.

Each additional compensating feature added to existing carburetors over the years makes them more complicated and more susceptible to plugging and therefore necessitate more frequent repairs and maintenance adjustments. In addition, the number of moving parts in carburetors has increased substantially over the years making such carburetors extremely complicated and increasingly expensive to manufacture.

An additional problem within prior art venturi and air valve carburetors is the inability to efficiently and effectively vaporize and mix fuel with the air prior to discharge into the intake manifold over the full range of engine operating conditions. It is therefore a principal object of the invention to provide a carburetor of very simple construction of the variable venturi type wherein the fuel is efficiently and effectively mixed with air prior to discharge into the intake manifold throughout the entire R.P.M. range and also throughout the full range of operating conditions.

An additional object is to provide a very simple carburetor with no moving parts in the fuel metering system while yet enabling substantial variance of the fuel air ratio over the full range of engine operating conditions in order to supply an optimum air fuel ratio to the cylinders under any operational condition.

An additional object is to provide a single throat carburetor that will operate as efficiently as any presently known multiple throat carburetor.

It is a yet further object to provide a variable venturi type carburetor that does not utilize an idle jet, an accelerator pump, a needle valve, or a butterfly throttle valve.

A further object is to provide such a carburetor that includes very simple adjustment features that enable ease in adjusting the carburetor idle settings and fuel to air ratio over the entire speed range.

These and still further objects and advantages of my invention will become apparent upon reading the following detailed description of a preferred embodiment.

BRIEF DESCRIPTION OF THE DRAWINGS

A preferred embodiment of my invention is illustrated in the accompanying drawings in which.

DESCRIPTION OF A PREFERRED EMBODIMENT

Figure 2:
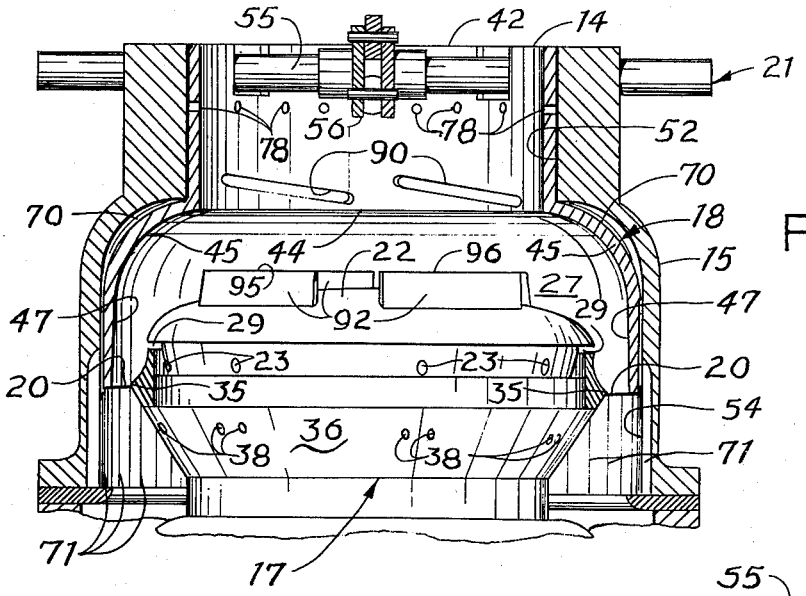
FIG. 2 is a fragmentary view showing different operational positions of the first and second venturi members.

A carburetor embodying the present invention is illustrated in the accompanying drawings and is generally designated therein by the reference numeral 10. The carburetor 10 is designed to be mounted to an internal combustion engine by innerconnection to the intake manifold of the engine. Although the carburetor illustrated is shown in an updraft configuration, it should be understood that several other configurations and embodiments may be utilized without deviating from the principles of my invention.

Basically, the present carburetor 10 is comprised of a hollow induction duct 12 having an open air intake end 13 and a remaining end 14 adapted to be fitted to an intake manifold of an internal combustion engine. The induction duct body is comprised of an upper casting 15 and a lower casting 16. Air is drawn into the carburetor through the intake end 13 along it's horizontal axis. The air is then guided vertically upward through the upper portion of casting 16 and into upper casting 15, hence inward through the intake manifold to the individual cylinders (not shown).

The carburetor 10 is basically comprised of three separate parts: the induction duct 12 as described; a first venturi member 17; and a second venturi member 18. The first and second venturi members 17 and 18 are coaxially located within the vertical portion of induction duct 12. Venturi members 17 and 18 coact with one another to create a restricted cross section 20 within the induction duct 12. A throttle means 21 is operatively connected to the second venturi member 18 to enable its axial movement relative to first venturi member 17 in order to change the amounts of air flow across the restricted cross section 20.

A plurality of fuel dispensing orifices 23 are provided within the first venturi member 17 to enable dispersion of fuel into the air moving by the restricted cross section 20 and into a mixing chamber 27. Fuel dispensing orifices 23 are operatively connected to a fuel supply means 24 that is designed to supply fuel automatically to the orifices 23 in response to differing operational conditions. In addition, an idle fuel supply means 25 is provided to supply fuel to mixing chamber 27 under idle conditions. Idle air is supplied to the mixing chamber 27 through an idle air supply means 26 that bypasses the venturi members.

The above brief and general description has been given in order to achieve an initial basic understanding of my carburetor. With this basic understanding a more detailed description may now be easily understood.

Reference will now be made to the first venturi member 17 and in particular, to FIGS. 1 and 5. Venturi 17 is centrally located within the air passageway defined by the upright portion of induction duct 12. Starting with the downstream portion (with regard to directional air flow through induction duct 12), the first venturi member 17 begins with a curved surface 22 facing the outlet end 14 of induction duct 12. Curved surface 22 leads radially outward and upstream slightly to an annular rim 35. An annular groove 29 is defined by an upstream groove edge 31 and an axially spaced downstream groove edge 33 within curved surface 22. Fuel orifices 23 openly communicate with groove 29 as shown in FIG. 5.

Figure 1:
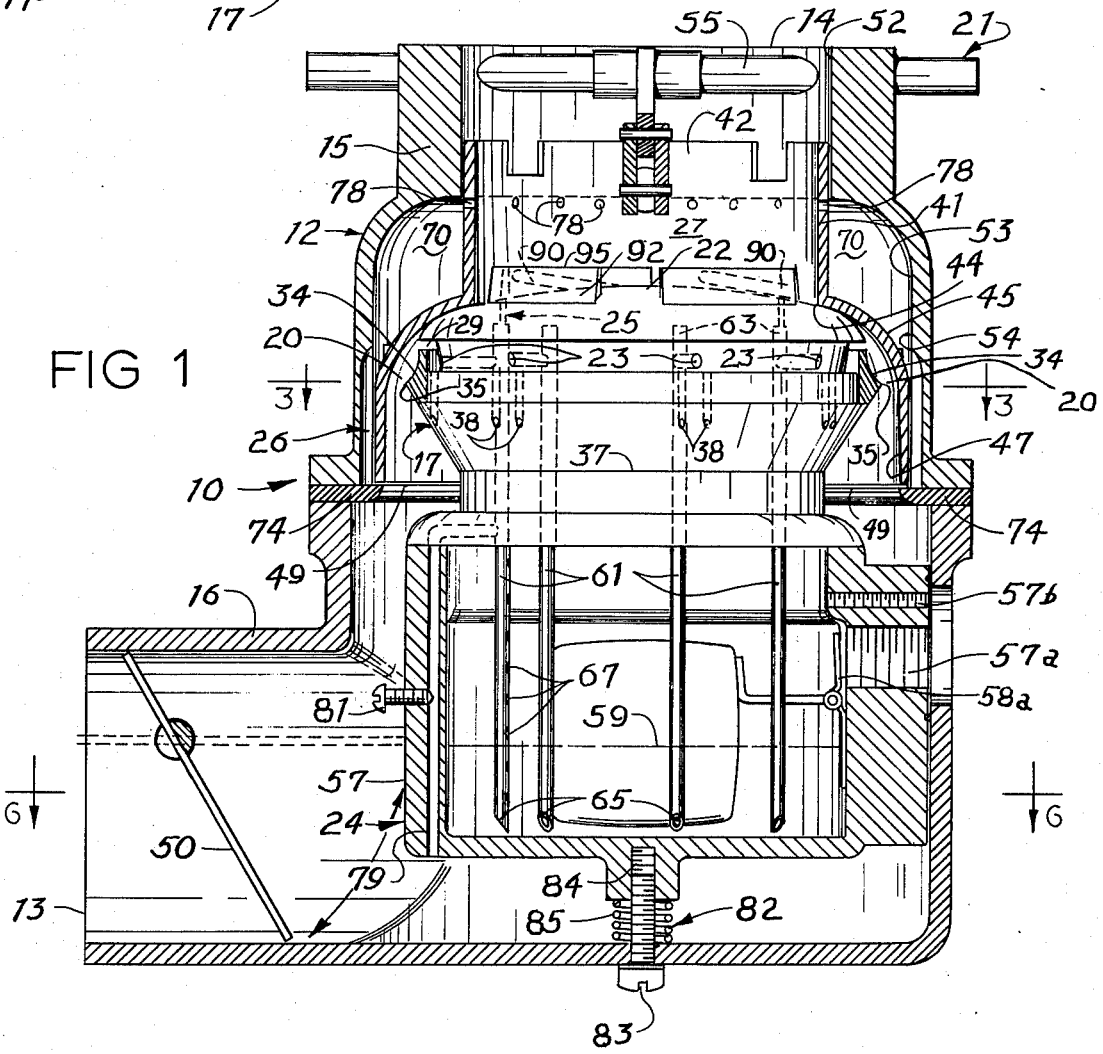
FIG. 1 is a vertically sectioned elevation view of the present carburetor.
Figure 4:
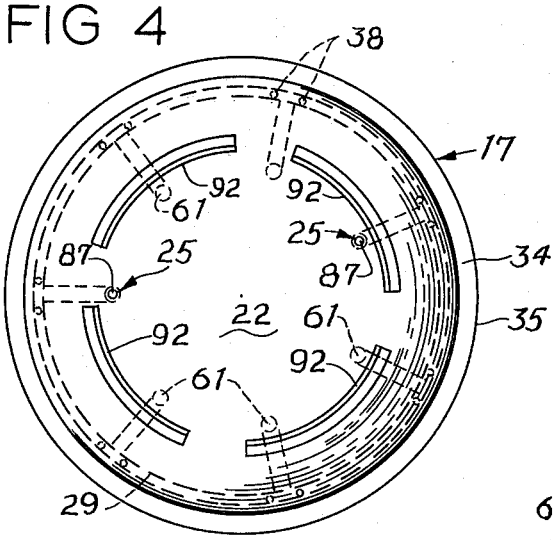
FIG. 4 is a plan view of the first venturi member.
Figure 5:
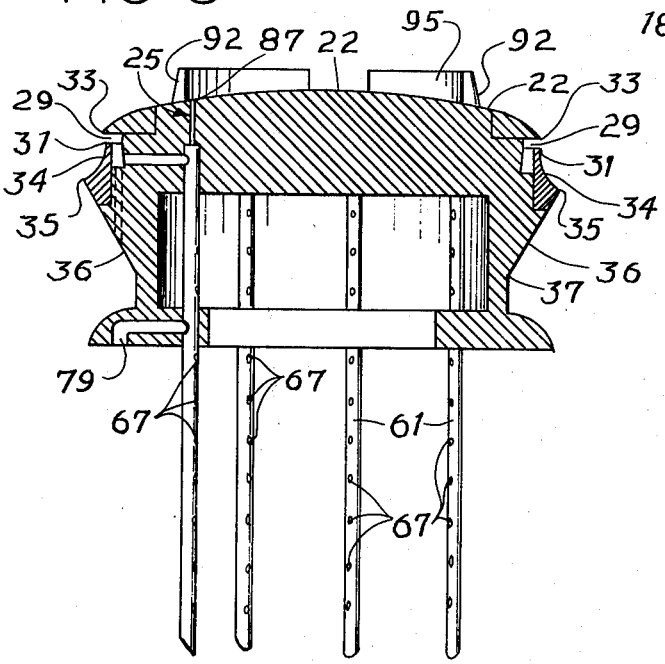
FIG. 5 is a section view taken along line 5—5 through FIG. 4.

A convex surface 34 leads upstream from groove edge 33 to rim 35 as may be noted in FIGS. 1, 2 and 5. Rim 35 is the furthermost radial protrusion on the first venturi member 17 and defines the inner border or boundary of the restricted cross section 20. An annular surface 36 then extends further upstream from annular rim 35. Surface 36 converges radially and in an upstream direction to a peripheral edge 37 of circular cross section. A plurality of open axial bleed ducts 38 extend through member 17 from surface 36 to open into groove 29. Bleed ducts 38 are arranged in pairs adjacent each fuel dispensing orifice 23 (FIG. 1).

Figure 3:
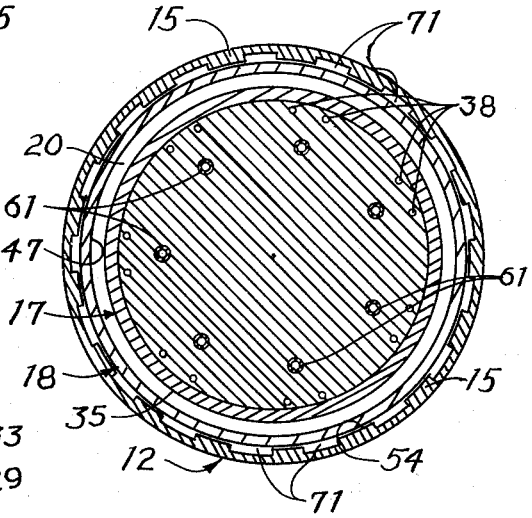
FIG. 3 is a sectional view taken substantially along line 3—3 in FIG. 1.

The second venturi member is illustrated in detail in FIGS. 1, 2 and in cross section in FIG. 3. Second venturi 18 is comprised of a circular, tubular downstream portion 41 having an open end 42 leading upstream to an upstream edge 44. This portion 41 between end 42 and edge 44 is cylindrical in configuration. Venturi member 18 extends arcuately outwardly and axially upstream from edge 44 in an outwardly flared bell shaped portion 45. The arcuate flared portion 45 extends axially upstream into an inner conical surface 47 that flares slightly radially outward to an upstream edge 49. As may be noted in comparing FIGS. 1 and 2, the flared surface 45 is utilized to vary the size of cross section 20 between the annular rim 35 and surface 45 to thereby control the passage of air through the restricted cross section 20.

Second venturi member 18 slidably fits within upper casting 15. Duct 12 includes, within upper casting 15, a cylindrical section 52 that is complementary to and slidably receives the tubular downstream portion 41 of second venturi member 18. It may be noted both in FIGS. 1 and 2 that this fit is substantially close and that relatively little air may escape between the outside wall of tubular portion 41 of venturi member 18 and the inside walls of the first cylindrical portion 52 of duct 12. A flared bell shaped portion 53 extends radially outward and axially upstream from cylindrical portion 52 that is complementary to the flared portion 45 of second venturi member 18. Flared portion 53 extends axially upstream to a second cylindrical upstream portion 54. Cylindrical portion 54 extends upstream from flared portion 53 to the lower edge of casting 15. Portion 54 is formed about a radius from the axes of venturi members 17 and 18 that is greater than the radius to the outside wall of the outwardly flared surface 47 of second venturi member 18. This enables a sliding fit between venturi member 18 and cylindrical portion 54 of induction duct 12. Again, the radii of the two adjacent surfaces are sufficiently close so little or no air escapes unintentionally between the venturi member 18 and duct 12, with the exception of the idle air supply means 26.

Restricted cross section 20 is defined between venturi members 17 and 18 as an open annular space (FIG. 3) between rim 35 and surface 47. Rim 35 defines the inside periphery of the annular space while surface 47 defines the outer periphery.

Figure 6:
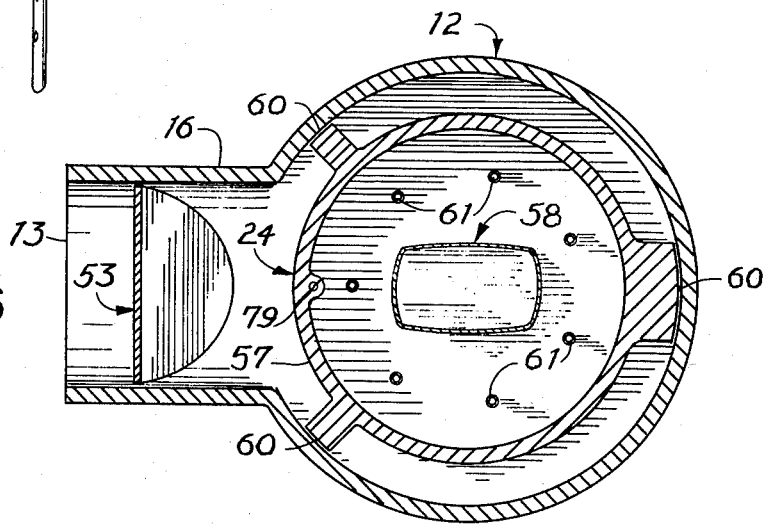
FIG. 6 is a reduced sectional view taken along line 6—6 in FIG. 1.

The throttle means 21 is comprised of a control rod 55 that mounts a linkage assembly 56 that in turn is connected to a second venturi member 18. Control rod 55 may be connected to a conventional type throttle linkage which operates in response to depression and release of a throttle pedal. In addition to the rather conventional throttle means 21, a choke assembly 50 is provided. Choke assembly 50 (FIGS. 1 and 6) utilizes an ordinary butterfly type valve that may be manually operated or automatically operated to control the amount of air intake through the induction duct 12. Conventional means may be utilized either in a manual or automatic mode to operate choke assembly 50.

The fuel supply means 24 is designed to receive fuel through conventional fuel supply fittings and hoses extending from the vehicle fuel tank. Means 24 includes a float chamber 57 axially movably located within induction duct 12.

Float chamber 57 is upwardly open to support the first venturi member 17 coaxially within induction duct 12. The chamber (and therefore venturi member 17) is axially movable in duct 12 through means of an idle air adjusting means 82 (FIG. 1) which operatively connects chamber 57 to lower casting 16. Means 82 is introduced at this point only to show how and where venturi member 17 and chamber 57 are supported within duct. Greater emphasis will be placed on means 82 at an appropriate time later in this specification.

Chamber 57 is axially guided within duct 12 by radially projecting shoulders 60 (FIG. 6) that slidably engage the inner walls of duct 12. Shoulders 60 enable upstream and downstream axial movement of venturi member 17 and chamber 57 while preventing undesired lateral movement.

Chamber 57 includes a somewhat conventionally float regulated fuel intake means 58. Such means usually include a conventional hinged float operatively connected to the chamber 57 to control an intake valve fitted within an appropriate threaded hole 57*a* in the chamber 57. As the fuel level rises to a preselected level 59 (FIG. 1), the float also rises to corresponding position whereat the valve is automatically shut off in response to pivotal movement of an actuating member 58*a* located at its outlet end. In addition, chamber 57 is adapted to receive conventional breather mechanisms within a threaded aperture 57*b* whereby fumes from the fuel within float chamber 57 may be recycled to the vehicle fuel tank rather than being exhausted into the open air to pollute the atmosphere.

As noted in FIG. 1, the first venturi member 17 rests on the float chamber 57. A plurality of upright tubes 61 included with fuel supply means 24 extend into and partially through the first venturi member 17 and downwardly into the float chamber 57. The tubes 61 include upper ends 63 that are located adjacent to but upstream from the curved surface 22 of member 17. The lower ends of upright tubes are indicated at 65. Ends 65 extend below the preselected fuel level 59 and are downwardly open to receive fuel therein. In addition to the open lower ends, fuel is supplied to tubes 61 through a plurality of vertically spaced apertures 67 within each tube 61. Apertures 67 extend along each tube 61 from below the preselected fuel level to above the fuel level. Therefore, in operation, the apertures will draw not only fuel but fumes or air within the float chamber 57 in order to achieve a premixed condition before the fuel is delivered to fuel dispensing orifices 23 or the idle fuel supply means 25.

By adjusting fuel intake means 58, the preselected fuel level 59 may be relocated up or down within float chamber 57 to increase or decrease the number of apertures 67 covered by the fuel. As a result, more or less air vapor from above the fuel level in chamber 57 is taken through the apertures 67 into the tubes 61 and consequently out through fuel supply orifices 23. If a rich mixture is desired, the preselected fuel level 59 is raised to cover more apertures 67. In this manner, more fuel is drawn through the apertures and into tubes 61. If a leaner mixture is desired, the preselected fuel level 59 is lowered to open more apertures 67 to the air space above the fuel level 59. In this manner more air is drawn through the apertures 67 to be premixed with the fuel drawn through tubes 61.

As may be noted in FIG. 1, the idle fuel supply means 25 is connected to two of the upright tubes 61 at their upper ends 63. The idle fuel supply means is simply comprised of upright ducts 87 formed through first venturi member 17 extending from the upper ends of tubes 61 and opening at the surface 22. The ducts 87 are open to receive fuel from the tubes 61 in response to suction from the engine.

The idle air supply means 26 includes a cooperation of elements of both the second venturi member 18 and portions of the induction duct 12.

Idle air supply means 26 includes vertical, axial channels 71 (FIGS. 1, 2 and 3) formed within the cylindrical portion 54 of induction duct 12. The channels 71 are axially positioned in relation to the restricted cross section 20 and radially outward from venturi members 17 and 18 so that air may be directed past both these members into an annular chamber 70 (FIGS. 1 and 2) formed between member 18 and the flared portion 53 of duct 12. Idle air exits into mixing chamber 27 through a plurality of idle air supply orifices 78 formed through venturi member 18.

Chamber 70 has a variable volume in correspondence to movement of the second venturi member 18 within duct 12. The differing volumes are best illustrated with reference to FIGS. 1 and 2.

An operational relationship of the elements thus described is illustrated in FIG. 1 wherein the first venturi member 17 and the second venturi member 18 are engaged at curved surface 22 and the upstream edge 44 on second venturi member 18. In this condition, members 17 and 18 cooperate to block passage of air past the restricted cross section 20. However, air is guided past edge 49, through channels 71 and through annular air chamber 70 into the mixing chamber through idle air supply orifices 78. Air is allowed into channels 71 since the channels 71 extend slightly upstream of the upstream edge 49 on second venturi member 18.

A rounded shoulder 74 is located between castings 15 and 16 at the upstream ends of channels 71 and extends radially inward toward the axes to the inner surface of edge 49. The venturi member edge 49, however, does not rest upon shoulder 74. Rather, it is held slightly above (downstream) the shoulder 74 to allow idle air to be drawn into channels 71 and subsequently into the annular air chamber 70 and subsequently through orifices 78 into the mixing chamber 27.

The idle air supply orifices 78 are axially located (FIG. 1) adjacent to the juncture of cylindrical portion 52 and flared portion 53 of duct 12. This positioning provides an idle air cutout means that is utilized to progressively decrease the supply of air to mixing chamber 27 through orifices 78 as the second venturi member 18 is moved axially downstream from first venturi member 17. Air that would normally pass through the supply orifices 78 is then redirected through an intermediate R.P.M. air supply (discussed in greater detail below).

Additional air is supplied to the idle fuel supply means 25 through an idle air bleed duct 79 extending through the float chamber 57. Bleed duct 79 communicates openly with one of the upright tubes 61 to facilitate passage of air from an opening upstream of the restricted cross section 20. The bleed duct 79 includes a bleed air adjusting means 81 in the form of a screw positioned in bleed duct 79. The screw may be selectively adjusted into or out of duct 79 to increase or decrease the idle bleed air flow.

As briefly mentioned above, an idle air adjusting means 82 is provided to enable selective adjustment of the amount of air bypassing the restricted cross section 20 to be drawn into mixing chamber 27 through the air supply orifices 78. Adjusting means 82 is shown in FIG. 1 in the form of a screw 83 communicating between induction duct 12 and float chamber 57. The screw 83 extends through an appropriate aperture in induction duct 12 to threadably engage float chamber 57 within a threaded aperture 84. A compression spring 85 is located between the chamber 57 and induction duct 12 to hold the position of first venturi member 17 and float chamber 57 axially within induction duct 12. Adjustment of screw 83 serves to narrow or widen the gap between edge 49 and the shoulder 74 at the upstream ends of axial channel 71. The amount of air allowed to enter into channels 71 is thereby controlled during idle conditions.

Provision is made within the idle air supply system for an intermediate R.P.M. phase air supply that bypasses the restricted cross section 20. This system is comprised of intermediate R.P.M. phase air bypass ducts 90 located adjacent to the upstream edge 42 of venturi member 18. These ducts 90 are inclined with respect to a plane perpendicular to the venturi axes. A number of axial surfaces 92, equal to the number of bypass air ducts 90, are included on first venturi member 17. The axial surfaces 92 are arranged to slidably engage the tubular portion 41, covering ducts 90 while member 18 is located in the idle and low R.P.M. range. As venturi member 18 is lifted axially away from venturi member 17, the intermediate R.P.M. phase air ducts 90 become progressively more exposed over downstream edges 95 of surfaces 92. At midrange R.P.M., the air ducts 90 are completely exposed to the annular air chamber and receive air freely from chamber 70 through channels 71. As the second venturi member 18 approaches the full throttle condition (FIG. 2) the bypass ducts 90 become progressively covered by first cylindrical portion 52 of induction duct 12. Finally, in a full throttle condition, (FIG. 2), the ducts 90 are fully covered as shown in FIG. 2 with all the air passing through the restricted cross section 20.

From the above detailed technical disclosure, operation of the present invention may now be understood. To begin with, in a starting condition, the choke may be applied as shown in solid lines in FIG. 1. In this setting, suction from the cylinders on their intake stroke results in the suction of fuel through the idle fuel supply means 25. With relatively little air being drawn into the carburetor, a relatively rich mixture of fuel to air is supplied to the cylinders to facilitate starting.

Once the engine is started, the choke may be moved to the position shown by dashed lines in FIG. 1 to completely open the induction tube 12 and allow free passage of air through opening 13.

At idle conditions, the carburetor would appear as shown in FIG. 1. In this phase, air is drawn through induction tube opening 13, about the float chamber 57, upwardly over the shoulder 74 and through the space between the shoulder 74 and edge 49 of second venturi member 18. From here, the air proceeds upwardly through channels 71 and finally into the mixing chamber 27 through annular air chamber 70 and the idle air supply orifices 78. Suction from the cylinders is sufficient in this condition to draw enough air through idle air supply orifies 78 and fuel through ducts 87 to operate the engine at an idle R.P.M. This mixture may be made more lean or rich simply by adjusting idle air adjusting means 82 to widen or narrow the gap between edge 49 and shoulder 74. Further adjustments may be made by adjusting the idle air bleed screw of adjusting means 81.

An air bleed system is also provided through the fuel dispensing orifices 23 in the idle condition shown in FIG. 1. As fuel is drawn through tubes 61 to the open ducts 87 leading from tubes 61 to mixing chamber 27, air is also drawn in through the fuel dispensing orifices 23 to premix with the fuel before it is ejected through the idle fuel ducts 87. By drawing air through the fuel dispensing orifices 23, a more complete premixture of air and fuel is affected before the mixture passes through ducts 87 and into chamber 27. This is an advantage since relatively little mixture of fuel to air occurs from turbulence within the chamber 27 since idle air is supplied through the idle air supply orifices 78 and not across the orifices 87 as they open into chamber 27.

It may be noted from the above description that in the idle condition, little or no air passes through the restricted cross section 20. The air supplied to mixing chamber 27 is that supplied through the annular air chamber 70 and the premixed air supplied through the idle fuel supply means 25.

As the throttle pedal is depressed, the throttle means 21 operates in response thereto to move the second venturi member 18 axially away from first venturi member 17. As this happens, an air passage is opened between the venturi members. The restricted cross section 20 then operates to increase the velocity of air passing through the carburetor at that point. As the air rushes by the gap between shoulder 28 and annular groove 29 of first venturi member 17, a low pressure area is formed, drawing a premixture of fuel and air through the supply orifices 23. The fuel mixes with the air supply through restricted cross section 20 and is further mixed in a turbulent atmosphere within mixing chamber 27 before it passes on into the intake manifold.

This turbulent effect in mixing chamber 27 is increased as the intermediate R.P.M. phase air ducts 90 are progressively opened in response to movement of second venturi member 18. Air entering through these ducts 90 is radially oriented and intersects with the substantially axially moving air entering through cross section 20.

As the second venturi member 18 is moved further upwardly, the flared upstream portion 45 widens the distance between annular rim 35 and the inside flared surface 45. At this space widens, additional air is allowed to enter into the mixing chamber 27 along with additional fuel supplied from orifices 23 to increase engine R.P.M.

Concave surface 34 on first venturi member 17 influences the low pressure area at groove 29. This low pressure condition serves to draw fuel through orifices 23 at an optimum ratio to the volume of air throughout the entire R.P.M. range. It has been found that if the surface 34 were convex rather than concave, the resulting effect would be to produce a too rich mixture of fuel to air, resulting in low operating efficiency.

FIG. 2 shows a full throttle position of the venturi members in order to produce an optimum passage for fuel and air mixture to the cylinders. In this condition, the relatively compact mixing chamber 27 is enlarged to the extent of the area inside the conical surface 47 of second venturi member 18. The velocity of air past restricted cross section 20 is increased at the full throttle condition since the area across restricted cross section 20 is increased and since passage of air is reduced through bypass ducts 90 as they are covered by first cylindrical portion 52 of induction duct 12. The air that would normally flow through ducts 90 is taken instead through the restricted cross section 20. The resulting increased volume of air at section 20 results in corresponding increased air velocity through section 20. This, in turn, works to create greater suction across the fuel supply orifices 23. The rich mixture required for full throttle operation is therefore obtained.

During deceleration, the arrangement of first and second venturi members 17 and 18 is again as shown in FIG. 1. During this phase, the engine is normally at a higher R.P.M. than at an idle condition and therefore a relatively strong vacuum is applied through the induction duct 12. However, because the second venturi member 18 is located to block passage of air over the cross section 20, air flow is restricted to that provided through idle air supply means 26. To limit the amount of fuel drawn through the idle fuel ducts 87 into the mixing chamber 27, air is fed into fuel ducts 87 through the fuel dispensing orifices 23. The result is that relatively little fuel is drawn from float chamber 57 while larger amounts of air are drawn in through the fuel dispensing orifices 23. In addition to this feature, the idle air bleed duct 79 is operative to supply additional air to the single tube 61 associated therewith. Therefore, under decelerating conditions, relatively little fuel is drawn into the cylinders and wasted as the vehicle slows under conpression.

Throughout the differing operational modes of the carburetor as described above, fuel is continuously supplied to mixing chamber 27 in a substantially premixed state. Provision of apertures 67 in tubes 61 facilitates premixture of fuel and air before its exits through orifices 23 or idle fuel ducts 87 with idle bleed duct 79 assisting during idle and deceleration. As described, the apertures 67 above the fuel level draw air or vapor from within chamber 57 to premix with the fuel being drawn through the apertures below the fuel level. During intermediate and high R.P.M., if fuel and air have not been sufficiently premixed before exiting through orifices 23, raw fuel will settle within groove 29. Ducts 38 are provided to bleed air into the groove area to mix with this raw fuel before it is drawn into the mixing chamber 27.

The rich premixture is thinned with the turbulent air passing through idle air orifices 78, or cross section 20, and intermediate phase ducts 90 entering chamber 27. The total effect is that the fuel and air are completely mixed in precisely the correct proportions, according to demand from the engine, before entering the intake manifold.

It is intended that the above description and attached drawings be taken only by way of example, it being understood that various changes and modification may be made therein without departing from the intended scope of my invention. Therefore, only the following claims are to be taken as definitions of my invention.

What I claim is:

1. A carburetor for an internal combustion engine, comprising:

an induction duct having an open air intake end, an intermediate mixing chamber and a remaining end adapted to be mounted to an intake manifold for receiving and guiding air downstream from the intake end through the mixing chamber to the remaining end and into the intake manifold in response to operation of the engine;

a fuel dispensing orifice located within the induction duct;

means for supplying fuel to the fuel dispensing orifice in response to movement of air through the induction tube;

a first venturi member located within the induction duct along a central axis and adjacent the fuel dispensing orifice immediately upstream of the mixing chamber;

a second venturi member located within the induction duct operatively associated and coaxial with the first venturi member to create a restricted cross section across the induction duct;

said second venturi member having a tubular downstream portion with an upstream edge and a downstream edge; an outwardly flared portion extending arcuately outward and upstream from the upstream edge of the tubular downstream portion; a conical upstream portion extending upstream from the outwardly flared portion and having an upstream diameter increasing tc an upstream edge; and throttle means enabling relative selective axial movement of the venturi members to selectively change the area of the restricted cross section and control the flow of air into the intake manifold.

2. The carburetor as recited in claim 1 wherein:

the second venturi member is operatively engaged by said throttle means to move axially in response thereto relative to the first venturi member between an idle position and a full throttle position; and wherein the downstream edge of the tubular downstream portion rests against the convex surface of the first venturi member in the idle position and the downstream edge is spaced downstream of the convex surface in the full throttle position.

3. The carburetor as recited in claim 2 wherein the induction duct icludes a complementary inside configuration for slidably receiving the second venturi member comprising:

a first cylindrical portion slidably receiving the tubular downstream portion of the second venturi member;

a flared portion complementary to the outwardly flared portion of the second venturi member; and an upstream cylindrical portion receiving the upstream edge and conical upstream portion of the second venturi member for axial sliding movement therein.

4. The carburetor as recited in claim 3 further comprising:

an idle air duct formed by an axial channel within the upstream cylindrical portion of the induction tube leading from a location upstream of the restricted cross section to a location downstream of the restricted cross section;

an annular air chamber formed between the second venturi member and induction duct openly communicating with the idle air duct;

an idle air supply orifice extending radially through the tubular downstream portion of the second venturi member to openly join the mixing chamber and annular air chamber;

idle fuel supply means associated with said fuel supply means for supplying fuel to the air in said mixing chamber.

5. The carburetor as recited in claim 4 further comprising:

idle air adjusting means interconnecting the first venturi member and induction duct for enabling selective axial adjustment of the first venturi member within the induction duct.

6. The carburetor as recited in claim 5 further comprising:

an intermediate phase throttle bypass air duct within the tubular portion of the second venturi member axially adjacent its upstream edge openly joining the annular air chamber with the mixing chamber; and an axial surface on the first venturi member slidably engaging the second venturi member and in axial alignment with the intermediate phase throttle bypass air duct, said surface terminating at a downstream edge located in relation to the idle air supply orifice so as the second venturi member is moved axially away from the first venturi member the bypass air duct is progressively opened.

7. A carburetor for an internal combustion engine, comprising:

an induction duct having an open air intake end, an intermediate mixing chamber and a remaining end adapted to be mounted to an intake manifold for receiving and guiding air downstream from the intake end through the mixing chamber to the remaining end and into the intake manifold in response to the operation of the engine;

a first venturi member located centrally within the induction duct aong a central axis communicating with the mixing chamber;

a second venturi member movably mounted within the induction duct communicating with the mixing chamber and, operatively associated with and coaxial to the first venturi member for movement between an idle position and a full throttle position to create a restricted variable cross section between the venturi members to control a main flow of air into the mixing chamber;

said first venturi member having an annular rim at the restricted cross section and an annular fuel dispensing groove formed therein downstream of the annular rim;

fuel supply means communicating with the annular fuel dispensing groove for supplying fuel to the mixing chamber;

said second venturi member having a bell-shaped portion opposing and concentric to the annular rim and the fuel dispensing groove at the restricted cross section;

an idle air supply means within the duct concentrically about the exterior of the second venturi member and responsive to the position of the second venturi member for directing idle air axially over the exterior of the second venturi member and into the mixing chamber when the second venturi member is in the idle position and for reducing the flow of idle air over the exterior of the second venturi member and into the mixing chamber as the second venturi member is moved to the full throttle position; and throttle means operatively connected to the second venturi means for moving the bell-shaped portion between the idle position and the full throttle position.

8. The carburetor as defined in claim 7 further comprising an idle fuel duct formed in the first venturi member communicating with the mixing chamber and operatively connected to the fuel supply means for supplying fuel to the mixing chamber to be mixed with the idle air.

9. The carburetor as defined in claim 7 wherein the fuel supply means includes a fuel chamber for receiving fuel therein and a plurality of fuel tubes extending into the fuel chamber with lower ends below a fuel level and with upper ends communicating with the annular fuel dispensing groove at angularly spaced fuel orifices within the groove.

10. The carburetor as defined in claim 9 further comprising upstream air bleed ducts extending axially through the first venturi member communicating with the annular fuel dispensing groove adjacent the fuel orifices to facilitate rapid mixing of the air and fuel in the mixing chamber.

11. The carburetor as defined in claim 9 where each of the upright fuel tubes have a plurality of apertures formed therein with at least one of the apertures being formed therein below the fuel level and with at least one of the apertures being formed therein above the fuel level to bleed air into the fuel tube.

12. A carburetor for an internal combustion engine, comprising;

an induction duct having an open air intake end, an intermediate mixing chamber and a remaining end adapted to be mounted to an intake manifold for receiving and guiding air downstream from the intake end through the mixing chamber to the remaining end and into the intake manifold in response to operation of the engine;

a first venturi member located centrally within the induction duct along a central axis communicating with the mixing chamber;

a second venturi member located within the induction duct communicating with the mixing chamber and operatively associated with and coaxial about the first venturi member to create a restricted cross section across the induction duct between the first and second venturi members;

said first venturi member having an annular rim at the restricted cross section;

said first venturi member having an annular fuel dispensing groove formed therein spaced downstream and radially inward of the annular rim;

said first venturi member having an annular convex surface extending radially inward and downward from the rim to the annular fuel dispensing groove;

fuel supply means communicating with the annular fuel dispensing groove for supplying fuel to the mixing chamber;

said second venturi member having a flared annular concave surface opposing the annular convex surface of the first venturi member that extends radially inward and downstream for directing a flow of air over the annular groove of the first venturi member downstream of the annular rim; and throttle means operatively connected to one of the venturi members for moving the venturi member relative to the other venturi member to selectively change the cross sectional area of the restricted cross section and control the flow of air into the intake manifold.

13. The carburetor as defined in claim 12 further comprising an idle fuel duct formed in the first venturi member and communicating with the mixing chamber and operatively connected to the fuel supply means for supplying a secondary source of fuel to the mixing chamber.

14. The carburetor as defined in claim 12 wherein the fuel supply means includes a fuel chamber for receiving fuel therein and a plurality of upright fuel tubes extending into the fuel chamber with lower ends below a fuel level and with upper ends communicating with the annular fuel dispensing groove at angularly spaced fuel orifices within the groove.

15. The carburetor as defined in claim 14 further comprising upstream air bleed ducts extending axially through the first venturi member communicating with the annular fuel dispensing groove adjacent the fuel orifices to facilitate rapid mixing of the air and fuel in the mixing chamber.

16. The carburetor as defined in claim 13 wherein each of the upright fuel tubes have a plurality of apertures formed therein with at least one of the apertures being formed below the fuel level and at least one of the apertures being formed above the fuel level to bleed air into the fuel tube.

17. The carburetor as defined in claim 12 further comprising an idle air supply means within the induction duct concentrically about the exterior of the second venturi member and responsive to the position of the second venturi member for directing idle air axially over the exterior of the second venturi member and into the mixing chamber when the second venturi member is in the idle position and for reducing the flow of idle air over the exterior of the second venturi member and into the mixing chamber as the second venturi member is moved to the full throttle position.

* * * * *